US009972422B1

(12) United States Patent
Sekhavat et al.

(10) Patent No.: US 9,972,422 B1
(45) Date of Patent: May 15, 2018

(54) COMMUNICATION CABLES WITH SEPARATORS FORMED FROM DISCRETE COMPONENTS OF INSULATION MATERIAL

(71) Applicant: Superior Essex International LP, Atlanta, GA (US)

(72) Inventors: Amir Sekhavat, Marietta, GA (US); William Bryan, Cumming, GA (US)

(73) Assignee: Superior Essex International LP, Atlanta, GA (US)

( * ) Notice: Subject to any disclaimer, the term of this patent is extended or adjusted under 35 U.S.C. 154(b) by 0 days. days.

(21) Appl. No.: 15/464,438

(22) Filed: Mar. 21, 2017

(51) Int. Cl.

| | |
|---|---|
| ***H01B 7/00*** | (2006.01) |
| ***H01B 11/02*** | (2006.01) |
| ***H01B 11/08*** | (2006.01) |
| ***H01B 11/04*** | (2006.01) |
| ***H01B 13/02*** | (2006.01) |
| ***H01B 13/22*** | (2006.01) |
| ***H01B 7/295*** | (2006.01) |
| ***H01B 7/282*** | (2006.01) |
| ***H01B 13/00*** | (2006.01) |

(52) U.S. Cl.
CPC ..... *H01B 11/08* (2013.01); *H01B 7/282* (2013.01); *H01B 7/295* (2013.01); *H01B 11/04* (2013.01); *H01B 13/0036* (2013.01); *H01B 13/02* (2013.01); *H01B 13/22* (2013.01)

(58) Field of Classification Search
CPC .... C08F 114/20; C08F 114/22; C08F 210/16; C08F 214/245; C08F 214/262; C08F 214/265; G02B 6/44; G02B 6/449; G02B 6/4401; G02B 6/4413; G02B 6/4433; G02B 6/4434; G02B 6/4436; G02B 6/4486; H01B 7/17; H01B 7/282; H01B 7/295; H01B 11/002; H01B 11/04; H01B 11/08; H01B 13/02; H01B 13/22; H01B 13/0036
USPC ..... 174/24, 113 R; 385/101, 113
See application file for complete search history.

(56) References Cited

U.S. PATENT DOCUMENTS

| | | | | |
|---|---|---|---|---|
| 4,255,545 A * | 3/1981 | Hurlock | C08F 120/06 | 525/274 |
| 4,324,453 A | 4/1982 | Patel | | |
| 4,484,159 A * | 11/1984 | Whitley | H01R 13/719 | 333/182 |
| 4,870,117 A | 9/1989 | Levy | | |
| 5,264,065 A * | 11/1993 | Kohm | H05K 1/0373 | 156/307.4 |
| 5,313,823 A * | 5/1994 | Berkman | G01M 3/165 | 174/11 R |
| 2006/0089672 A1* | 4/2006 | Martinek | A61L 17/04 | 606/228 |
| 2010/0027948 A1* | 2/2010 | Wasserman | H01B 7/295 | 385/101 |
| 2011/0144244 A1* | 6/2011 | Lee | C08K 3/0058 | 524/84 |

(Continued)

*Primary Examiner* — Timothy Thompson
*Assistant Examiner* — Guillermo Egoavil

(57) ABSTRACT

A communication cable may include a plurality of twisted pairs and a plurality of discrete components of insulation material positioned in the interstices between the plurality of twisted pairs. Each of the discrete components may have a largest dimension that is no greater than approximately 250 microns. The discrete components may provide separation between two or more of the twisted pairs. A jacket may be formed around the plurality of twisted pairs and the plurality of discrete components.

20 Claims, 5 Drawing Sheets

(56) References Cited

U.S. PATENT DOCUMENTS

| | | | | |
|---|---|---|---|---|
| 2013/0065049 | A1* | 3/2013 | Eispert | H01B 7/288<br>428/365 |
| 2014/0205249 | A1* | 7/2014 | Glew | G02B 6/449<br>385/101 |
| 2016/0012937 | A1* | 1/2016 | Shi | H02G 15/064<br>138/140 |
| 2016/0306129 | A1* | 10/2016 | Hurley | G02B 6/4434 |

* cited by examiner

COMMUNICATION CABLES WITH SEPARATORS FORMED FROM DISCRETE COMPONENTS OF INSULATION MATERIAL

TECHNICAL FIELD

Embodiments of the disclosure relate generally to communication cables and, more particularly, to communication cables incorporating a plurality of discrete components of insulation material between a plurality of twisted pairs.

BACKGROUND

A wide variety of different types of cables are utilized to transmit power and/or communications signals. In certain types of cables, it is desirable to provide separation for internal cable components. For example, certain cables make use of multiple twisted pairs of conductors to communicate signals. In each pair, the wires are twisted together in a helical fashion to form a balanced transmission line. When twisted pairs are placed in close proximity, such as within the core of a cable, electrical energy may be transferred from one pair of the cable to another pair. Such energy transfer between pairs is undesirable and is referred to as crosstalk. Crosstalk causes interference to the information being transmitted through the twisted pairs and can reduce the data transmission rate and cause an increase in bit rate error. Interlinking typically occurs when two adjacent twisted pairs are pressed together, and interlinking can lead to an increase in crosstalk among the wires of adjacent twisted pairs.

In order to improve crosstalk performance, separators (also referred to as separation fillers, fillers, interior supports, or splines) have been inserted into many conventional cables. These separators serve to separate adjacent twisted pairs and limit or prevent interlinking of the twisted pairs. However, conventional separators are often formed as continuous structures along the length of a cable. As a result, material cost of the separator and resulting cables are increased while the overall flexibility of the cable is reduced. Accordingly, there is an opportunity for improved cable structures in which material is utilized to provide separation between adjacent twisted pairs.

Additionally, when multiple cables, such as multiple twisted pair cables, are positioned in relatively close proximity to one another, alien crosstalk may occur between twisted pairs of the various cables. In order to mitigate the effects of alien crosstalk, it may be desirable to increase the separation distance between the cables. Accordingly, there is an opportunity for improved cable structures in which material is utilized to provide separation between twisted pairs and an outer jacket or other wrap, thereby increasing separation between adjacent cables.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1:
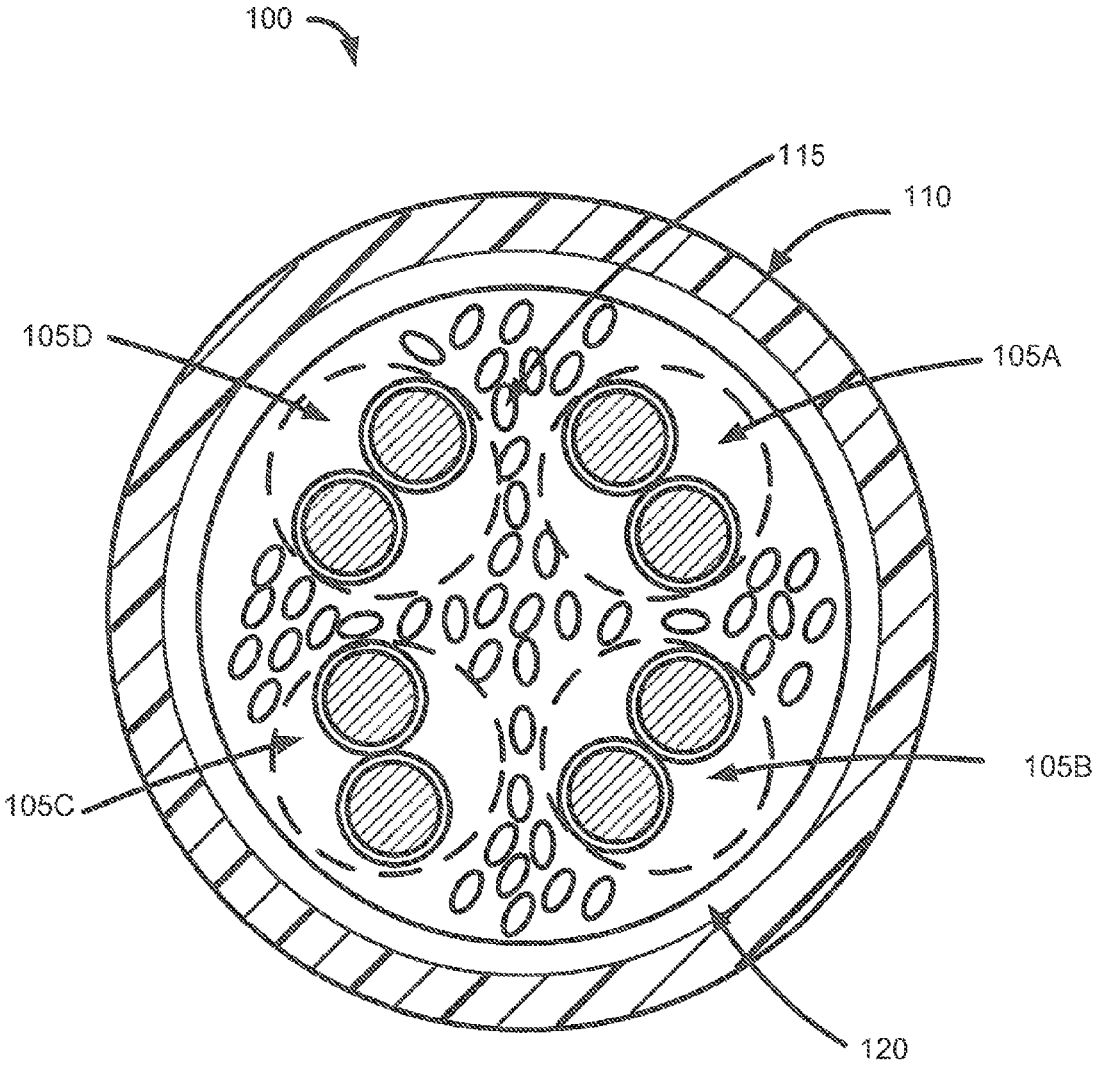
FIG. 1 is a cross-sectional view of an example twisted pair cable that includes discrete components of insulation material positioned between the twisted pairs, according to an illustrative embodiment of the disclosure.

Various embodiments of the present disclosure are directed to twisted pair communication cables that include or incorporate discrete components of insulation or dielectric material. In one example embodiment, a cable may include a plurality of twisted pairs of individually insulated conductors and a jacket or other suitable layer (e.g., a shield layer, etc.) formed around the plurality of twisted pairs. Additionally, a plurality of discrete components of insulation material may be positioned between two or more of the twisted pairs and/or between the twisted pairs and the outer jacket. In other words, the discrete components may be positioned within one or more interstices in the cable core. The discrete components may provide separation between adjacent twisted pairs and/or between the twisted pairs and outer jacket, thereby reducing crosstalk and/or improving electrical performance of the cable.

According to an aspect of the disclosure, the discrete components may include relatively small components that are loosely positioned within the cable. In other words, the discrete components are not directly adhered, bonded, or otherwise connected to one another. Additionally, the discrete components are not indirectly connected to one another via any number of common substrate layers, such as longitudinally extending tapes, etc. In certain embodiments, each of the discrete components may have a largest dimension (e.g., diameter, length, etc.) that is no greater than approximately 250 microns. Additionally, any number of discrete components may be incorporated into a cable, and the discrete components may be incorporated with any suitable density and/or filling ratio. In certain embodiments, discrete components may be incorporated relatively continuously along a longitudinal length of a cable. In other embodiments, discrete components may be incorporated into a cable at any number of spaced locations along a longitudinal length.

In certain embodiments, the discrete components may be formed from recycled insulation material. For example, when twisted pairs and/or various cables are scrapped, certain insulation components (e.g., conductor insulation, separators, cable jackets, etc.) may be collected and cut, chopped up, or otherwise processed in order to form the discrete insulation components. Accordingly, in certain embodiments, the discrete components may be sized in accordance with the dimensions of the reclaimed material. For example, if insulation is stripped from a conductor, discrete components formed therefrom may have a thickness or other dimensions that are approximately equal to the thickness of the reclaimed insulation. As desired, a wide variety of other materials may be blended or mixed with the discrete components. The mixture may then be incorporated into a cable. Example of suitable additives that may be blended with the discrete components include, but are not limited to, water blocking materials, super absorbent polymers, flame retardant material, smoke suppressants, extinguishants, etc.

Additionally, a wide variety of suitable systems and/or methods may be utilized as desired to incorporate discrete components into a cable. For example, as a plurality of twisted pairs are brought together and/or bunched (e.g., helically twisted together), discrete components may be positioned between the twisted pairs. In certain embodiments, the twisted pairs may be passed through a dust chamber or other suitable device that is filled with discrete components, and the discrete components may be trapped between the twisted pairs and/or may collect on outer surfaces of the twisted pairs. In other embodiments, discrete components may be positioned via air blowing the discrete components into interstices, via electrostatic charge, and/or via a wide variety of other suitable techniques. A jacket or other outer wrap may then be extruded or otherwise formed around the twisted pairs and discrete components. In certain embodiments, discrete components may be positioned between the twisted pairs and the outer wrap. In other embodiments, an outer periphery of the twisted pairs may be wiped or otherwise cleaned to remove discrete components prior to the formation of the outer wrap.

As a result of incorporating discrete components between a plurality of twisted pairs and/or between twisted pairs and an outer wrap, separation distances may be provided between various twisted pairs and/or between the twisted pairs and an outer wrap. These separation distances may assist in reducing crosstalk and/or improving the electrical performance of a cable. Additionally, in certain embodiments, separation may be achieved via the use of less material than that required in conventional cables utilizing relatively continuous separators. Indeed, in certain applications, separation may be achieved using recycled material. Thus, material and cable cost may be reduced. Further, the use of relatively small discrete components may contribute to increased cable flexibility and/or easier termination.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIG. 1 illustrates a cross-sectional view of an example twisted pair cable 100 that includes discrete components of insulation material positioned between the twisted pairs, according to an illustrative embodiment of the disclosure. The cable 100 is illustrated as a twisted pair communications cable; however, other types of cables may be utilized, such as composite or hybrid cables that include a combination of twisted pairs and other transmission media (e.g., optical fibers, etc.). Indeed, suitable cables may include any number of transmission media including but not limited to one or more twisted pairs, optical fibers, coaxial cables, and/or power conductors. Additionally, embodiments of the disclosure may be utilized in association with horizontal cables, vertical cables, flexible cables, equipment cords, cross-connect cords, plenum cables, riser cables, or any other appropriate cables.

With reference to FIG. 1, the cable 100 may include a plurality of twisted pairs 105A-D disposed within a cable core defined by an outer jacket 110. A plurality of discrete components 115 of insulation material may also be positioned within the cable core. For example, as shown, discrete components may be positioned between two or more of the twisted pairs 105A-D. As desired, a wide variety of other components, such as one or more shield layers 120 may be incorporated into the cable 100. Each of these components is described in greater detail below.

As shown in FIG. 1, the cable 100 may include four twisted pairs 105A, 105B, 105C, 105D; however, any other suitable number of pairs may be utilized. As desired, the twisted pairs 105A-D may be twisted or bundled together and/or suitable bindings may be wrapped around the twisted pairs 105A-D. In other embodiments, multiple grouping of twisted pairs may be incorporated into a cable. As desired, each grouping may be twisted, bundled, and/or bound together. Further, in certain embodiments, the multiple groupings may be twisted, bundled, or bound together.

Each twisted pair (referred to generally as twisted pair 105) may include two electrical conductors, each covered with suitable insulation. As desired, each of the twisted pairs 105A-D may have the same twist lay length or alternatively, at least two of the twisted pairs may include a different twist lay length. For example, each twisted pair may have a different twist rate. The different twist lay lengths may function to reduce crosstalk between the twisted pairs. A wide variety of suitable twist lay length configurations may be utilized. Additionally, in certain embodiments, each of the twisted pairs 105A-D may be twisted in the same direction (e.g., clockwise, counter clockwise). In other embodiments, at least two of the twisted pairs 105A-D may be twisted in opposite directions. Further, as desired in various embodiments, one or more of the twisted pairs 105A-D may be twisted in the same direction as an overall bunch lay of the combined twisted pairs. For example, the conductors of each of the twisted pairs 105A-D may be twisted together in a given direction. The plurality of twisted pairs 105A-D may then be twisted together in the same direction as each of the individual pair's conductors. In other embodiments, at least one of the twisted pairs 105A-D may have a pair twist direction that is opposite that of the overall bunch lay. In yet other embodiments, all of the twisted pairs 105A-D may have pair twist directions that are opposite that of the overall bunch lay.

The electrical conductors of a twisted pair 105 may be formed from any suitable electrically conductive material, such as copper, aluminum, silver, annealed copper, gold, a conductive alloy, etc. Additionally, the electrical conductors may have any suitable diameter, gauge, and/or other dimensions. Further, each of the electrical conductors may be formed as either a solid conductor or as a conductor that includes a plurality of conductive strands that are twisted together. The twisted pair insulation may include any suitable dielectric materials and/or combination of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, choloro-sulphonated polyethylene, flame retardant PVC, low temperature oil resistant PVC, flame retardant polyurethane, flexible PVC, or a combination of any of the above materials. Additionally, in certain embodiments, the insulation of each of the electrical conductors utilized in the twisted pairs 105A-D may be formed from similar materials. In other embodiments, at least two of the twisted pairs may utilize different insulation materials. For example, a first twisted pair may utilize an FEP insulation while a second twisted pair utilizes a non-FEP polymeric insulation. In yet other embodiments, the two conductors that make up a twisted pair may utilize different insulation materials.

In certain embodiments, the insulation may be formed from multiple layers of one or a plurality of suitable materials. In other embodiments, the insulation may be formed from one or more layers of foamed material. As desired, different foaming levels may be utilized for different twisted pairs in accordance with twist lay length to result in insulated twisted pairs having an equivalent or approximately equivalent overall diameter. In certain embodiments, the different foaming levels may also assist in balancing propagation delays between the twisted pairs. As desired, the insulation may additionally include other materials, such as a flame retardant materials, smoke suppressant materials, etc.

Each twisted pair 105 can carry data or some other form of information, for example in a range of about one to ten Giga bits per second ("Gbps") or another appropriate frequency, whether faster or slower. In certain embodiments, each twisted pair 105 supports data transmission of about two and one-half Gbps (e.g. nominally two and one-half Gbps), with the cable 100 supporting about ten Gbps (e.g. nominally ten Gbps). In certain embodiments, each twisted pair 105 supports data transmission of up to about ten Gbps (e.g. nominally ten Gbps), with the cable 100 supporting about forty Gbps (e.g. nominally forty Gbps).

The jacket 110 may enclose the internal components of the cable 100, seal the cable 100 from the environment, and provide strength and structural support. Similar to the twisted pair insulation, the jacket 110 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. The jacket 110 may be formed as a single layer or, alternatively, as multiple layers. In certain embodiments, the jacket 110 may be formed from one or more layers of foamed material. Additionally, the jacket 110 may include a wide variety of suitable shapes (e.g., cross-sectional shape such as the illustrated round jacket) and/or dimensions (e.g., inner diameter, outer diameter, thickness, etc.). In various embodiments, the jacket 110 can be characterized as an outer jacket, an outer sheath, a casing, a circumferential cover, or a shell.

An opening enclosed by the jacket 110 may be referred to as a cable core, and the twisted pairs 105A-D and other internal components may be disposed within the cable core. Although a single cable core is illustrated in FIG. 1, a cable may be formed to include multiple cable cores. Other elements can be added to the cable core as desired, for example one or more optical fibers, additional electrical conductors, additional twisted pairs, water absorbing materials, and/or strength members, depending upon application goals.

In certain embodiments, one or more shield layers can be disposed between the jacket 110 and one or more additional cable components. For example, as shown in FIG. 1, an external shield 120 or an overall shield may be disposed between the jacket 110 and the twisted pairs 105A-D. In other words, the external shield may be wrapped around and/or encompass the collective group of twisted pairs 105A-D. In certain embodiments, the shield 120 may be positioned between the twisted pairs 105A-D and the outer jacket 110. In other embodiments, the shield 120 may be embedded into the outer jacket 110, incorporated into the outer jacket 110, or even positioned outside of the outer jacket 120. In other example embodiments, individual shields may be provided for each of the twisted pairs 105A-D. In yet other embodiments, shield layers may be provided for any desired groupings of twisted pairs. As desired, multiple shield layers may be provided, for example, individual shields and an overall shield. One or more shield layers may incorporate electrically conductive material, semi-conductive material, or dielectric shielding material in order to provide electrical shielding for one or more cable components. Further, in certain embodiments, the cable 100 may include a separate, armor layer (e.g., a corrugated armor, etc.) for providing mechanical protection.

Various embodiments of the external shield 120 illustrated in FIG. 1 are generally described herein; however, it will be appreciated that other shield layers (e.g., individual shield layers, etc.) may have similar constructions. In certain embodiments, a shield 120 may be formed from a single segment or portion that extends along a longitudinal length of the cable 100. In other embodiments, a shield 120 may be formed from a plurality of discrete segments or portions positioned adjacent to one another along a longitudinal length of the cable 100. In the event that discrete segments or portions are utilized, in certain embodiments, gaps or spaces may exist between adjacent segments or portions. In other embodiments, certain segments may overlap one another. For example, an overlap may be formed between segments positioned adjacent to one another along a longitudinal length of the cable.

As desired, a wide variety of suitable techniques and/or processes may be utilized to form a shield 120 (or a shield segment). In certain embodiments, a foil shield or braided shield may be provided. In other embodiments, a shield may be formed from a combination of dielectric material and shielding material. As one example, a base dielectric material may be extruded, poltruded, or otherwise formed. Electrically conductive material or other shielding material may then be applied to the base material. In certain embodiments, a base layer and shielding layer may be bonded, adhered, or otherwise joined together to form a shield. In other embodiments, shielding material may be formed on a dielectric layer via any number of suitable techniques, such as the application of metallic ink or paint, liquid metal deposition, vapor deposition, welding, heat fusion, adherence of patches to the dielectric, or etching of patches from a metallic sheet. As desired, shielding material may be over coated with another dielectric layer. In certain embodiments, the shield 120 (or individual shield segments) may be formed as a tape that includes both one or more dielectric layers and one or more shielding layers. In other embodiments, shielding material may be injected into a base material or a shield 120 may be formed primarily from a shielding material (e.g., a dielectric shielding material). Indeed, a wide variety of suitable techniques may be utilized to incorporate shielding material into a shield 120.

In certain embodiments, the base layer of a shield 120 may have a substantially uniform composition and/or may be made of a wide range of materials. Additionally, the base layer may be fabricated in any number of manufacturing passes, such as a single manufacturing pass. Further, the base layer may be foamed, may be a composite, and/or may include one or more strength members, fibers, threads, or yarns. As desired, flame retardant material, smoke suppressants, and/or other desired substances may be blended or incorporated into the base layer. Examples of suitable materials that may be used to form a base or other dielectric layer include, but are not limited to, various plastics, one or more polymeric materials, one or more polyolefins (e.g., polyethylene, polypropylene, etc.), one or more fluoropolymers (e.g., fluorinated ethylene propylene ("FEP"), polyester, polytetrafluoroethylene, polyimide, or some other polymer, combination of polymers, or dielectric material(s) that does not ordinarily conduct electricity.

In certain embodiments, a shield 120 may be a relatively continuous shield (e.g., a shield with a relatively continuous layer of electrically conductive material, etc.) or a discontinuous shield having a plurality of isolated patches of shielding material. For a discontinuous shield, a plurality of patches of shielding material may be incorporated into the shield 120, and gaps or spaces may be present between adjacent patches in a longitudinal direction. A wide variety of different patch patterns may be formed as desired in various embodiments, and a patch pattern may include a period or definite step. In other embodiments, patches may be formed in a random or pseudo-random manner. Additionally, individual patches may be separated from one another so that each patch is electrically isolated from the other patches. That is, the respective physical separations between the patches may impede the flow of electricity between adjacent patches. In certain embodiments, the physical separation of other patches may be formed by gaps or spaces, such as gaps of dielectric material or air gaps.

A wide variety of suitable materials and/or combination of materials may be utilized to form shielding layers and/or patches of shielding material incorporated into a shield 120. In certain embodiments, one or more electrically conductive materials may be utilized including, but not limited to, metallic material (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. In other embodiments, one or more semi-conductive materials may be utilized including, but not limited to, silicon, germanium, other elemental semiconductors, compound semiconductors, materials embedded with conductive particles, etc. In yet other embodiments, one or more dielectric shielding materials may be utilized including, but not limited to, barium ferrite, etc.

The components of a shield 120 (or segment of a shield) may include a wide variety of suitable dimensions, for example, any suitable lengths in the longitudinal direction, widths (i.e., a distance of the shield that will be wrapped around one or more twisted pairs 105A-D) and/or any suitable thicknesses. For example, the dielectric or base portion of a shield 120 may have a thickness of about 1 to about 5 mils (thousandths of an inch) or about 25 to about 125 microns. Additionally, each patch of shielding material may have any desired thickness, such as a thickness of about 0.5 mils (about 13 microns) or greater. In many applications, signal performance benefits from a thickness that is greater than about 2 mils. Indeed, with a thickness of less than about 1.5 mils, negative insertion loss characteristics may be present on the cable 100.

A wide variety of segment and/or patch lengths (e.g., lengths along a longitudinal direction of the cable 100) may be utilized. As desired, the dimensions of the segments and/or patches can be selected to provide electromagnetic shielding over a specific band of electromagnetic frequencies or above or below a designated frequency threshold. In various embodiments, the segments and/or patches can have a length of about 0.05, 0.1, 0.2, 0.25, 0.3, 0.4, 0.5, 0.75, 1.0, 1.5, 2.0, 2.5, 3.0, 3.5, 4.0, 4.5, 5.0, 6.0, 7.5, 8.0, 10.0 meters, a length included in a range between any two of the above values, or a length included in a range bounded on either a minimum or maximum end by one of the above values. In the event that a plurality of patches is formed on a shield 120 or a shield segment (e.g., a plurality of patches in a longitudinal direction, a plurality of patches formed across a width dimension, etc.), a wide variety of suitable gap distances or isolation gaps may be provided between adjacent patches. For example, the isolation spaces may define a space between adjacent patches of about 0.5, 1.0, 1.5, 2.0, 2.5, 3.0, 3.5, 4, 5, 6, 7, 8, 9, 10, 15, 20, 25, or 30 millimeters, or a space included in a range between any two of the above values, or a space included in a range bounded on either a minimum or maximum end by one of the above values. Additionally, as desired, the patches may be formed as first patches (e.g., first patches on a first side of a dielectric material), and second patches may be formed on an opposite side of the shield 120 (e.g., on an opposite side of a dielectric material, etc.). For example, second patches may be formed to correspond with the gaps or isolation spaces between the first patches. As desired, the patches may have a wide variety of different shapes and/or orientations. For example, the patches may have a rectangular, trapezoidal, parallelogram, or other suitable shape.

In certain embodiments, patches may be formed to be approximately perpendicular (e.g., square or rectangular segments and/or patches) to the longitudinal axis of the adjacent one or more pairs 105A-D (e.g., pairs enclosed by a shield, pairs adjacent to a separator, etc.). In other embodiments, patches may have a spiral direction that is opposite or the same as the twist direction of the enclosed one or more pairs 105A-D. For example, if the twisted pair(s) 105A-D are twisted in a clockwise direction, then the patches may spiral in a counterclockwise direction. Thus, twisted pair lay opposes the direction of the segment and/or patch spiral. The opposite directions may provide an enhanced level of shielding performance.

In certain embodiments, a plurality of microcuts may be utilized to form a gap between two patches. For example, a plurality of microcuts having a respective width less than or equal to approximately 0.25 mm may be formed. These relatively narrow microcuts may limit the leakage of the shield 120, and therefore, reduce noise during electrical transmission using a cable. In certain embodiments, a series of microcuts may be placed in relatively close proximity to one another. For example, a series of microcuts may be formed as an alternative to a traditional space or gap between patches of shielding material. As one example, a conventional discontinuous shield may include gaps or spaces between adjacent patches that are at least approximately 0.050 inches (approximately 1.27 mm) wide. By contrast, a plurality of relatively narrow or fine microcuts (e.g., microcuts of approximately 0.25 mm, etc.) may be formed in an approximately 0.050 inch wide portion (or any other desired width) of a shield element. By positioning the microcuts in relatively close proximity to one another, any electrical arcing across the microcut gaps will likely burn up or destroy the electrically conductive material between the microcuts, thereby breaking or severing the electrical continuity of the shield 120 and preventing current from propagating down the shield element.

As an alternative to using microcuts to forms gaps or spaces between patches of electrically conductive material, a wide variety of other suitable configurations of microcuts may be utilized in other embodiments. For example, a shield 120 may include microcuts continuously spaced in close proximity to one another along its longitudinal length. In other embodiments, sections or patches of microcuts may be spaced at regular intervals or in accordance with any desired pattern. A wide variety of suitable patterns may be formed by microcuts. For example, a section of microcuts (e.g., one section of a repeating pattern, etc.) may include microcuts having a perpendicular line pattern, a dashed vertical line pattern, a square pattern, an inverse square pattern, a diamond-shaped pattern, an inverse diamond-shaped pattern, a checkerboard pattern, an angled line pattern, a curved line pattern, or any other desired pattern. As another example, a section of microcuts may include microcuts that form one or more alphanumeric characters, graphics, and/or logos. In this regard, product identification information, manufacturer identification information, safety instructions, and/or other desired information may be displayed on a shield element. In yet other embodiments, sections or patches of microcuts may be positioned in random locations along a shield element. Additionally, a wide variety of suitable methods and/or techniques may be utilized to form microcuts. For example, one or more lasers may be utilized to form microcuts.

According to an aspect of the disclosure, a plurality of discrete components 115 of insulation material may be incorporated into the cable 100. For example, as illustrated in FIG. 1, discrete components 115 may be positioned between two or more of the twisted pairs 105A-D. As explained in greater detail below with reference to FIG. 2, discrete components 115 may additionally or alternatively be positioned between the twisted pairs 105A-D and the outer jacket 110 or other suitable wrap, such as the external shield 120. In other words, the discrete components 115 may be positioned within one or more interstices in the cable core. The discrete components may provide separation between adjacent twisted pairs and/or between the twisted pairs 105A-D and outer jacket 110. In certain embodiments, the discrete components 115 may be configured to orient and or position one or more of the twisted pairs 105A-D. The orientation and/or separation of the twisted pairs 105A-D relatively to one another and/or other cable components may reduce crosstalk, improve electrical performance of the cable, and/or provide beneficial signal performance.

In certain embodiments, the discrete components 115 may include relatively small individual components that are loosely positioned within the cable. In other words, the discrete components 115 may not be directly adhered, bonded, or otherwise connected to one another. Additionally, the discrete components 115 may not be indirectly connected to one another via any number of common substrate layers, such as longitudinally extending tapes, yarns, etc. In certain embodiments, each of the discrete components 115 may have a largest dimension (e.g., diameter, length, etc.) that is no greater than approximately 250 microns. In other embodiments, each discrete component 115 may have a largest dimension that is approximately 50, 75, 100, 125, 150, 175, 200, 225, 250, 275, or 300 microns, a value included in a range between two of the above values, or a value included in a range that is bounded on a maximum end by one of the above values.

Additionally, although the discrete components 115 are formed as relatively small components, the discrete components 115 are not formed as a powder or as particulate matter (e.g., nanoparticles, etc.). Accordingly, in certain embodiments, the discrete components 115 may have one or more dimensions that are larger than approximately 50 microns. In other embodiments, each discrete component 115 may have at least one dimension (e.g., diameter, length, etc.) that is approximately 40, 50, 60, 70, 80, 90, 100, 110, 125, 140, or 150 microns, a value included in a range between two of the above values, or a value included in a range that is bounded on a minimum end by one of the above values. In certain embodiments, a minimum size of the discrete components 115 may be based at least in part on a desired separation to be created in the cable 100. For example, the discrete components 115 may be sized such that a discrete component 115 will provide a minimum desirable separation distance between two adjacent twisted pairs. As another example, the discrete components 115 may be sized such that a discrete component 115 will provide a minimum desirable separation distance between a twisted pair 105 and an outer wrap. Further given the minimum and maximum sizes of discrete component 115 set forth herein, it will be appreciated that discrete components 115 may be formed to include one or more dimensions that fall within a range between any two of the specified minimum and/or maximum values.

Discrete components 115 may be formed from a wide variety of suitable materials and/or combinations of materials. For example discrete components 115 may be formed from a wide variety of suitable dielectric and/or insulation materials. Examples of suitable materials include, but are not limited to, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), polyvinylidene fluoride ("PVDF"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials.

In certain embodiments, the discrete components 115 may be formed from recycled or repurposed insulation material.

For example, when twisted pairs and/or various cables are scrapped, certain insulation components (e.g., conductor insulation, separators, cable jackets, etc.) may be collected and cut, chopped up, or otherwise processed in order to form the discrete components 115. Accordingly, in certain embodiments, the discrete components 115 may be sized based at least in part on the dimensions of the reclaimed material. For example, if insulation is stripped from a conductor, discrete components 115 formed therefrom may have a thickness and/or other dimensions that are approximately equal to the thickness of the reclaimed insulation.

As desired, a wide variety of additives and/or other materials may be blended or mixed with the discrete components 115. The mixture may then be incorporated into a cable 100. Example of suitable additives that may be blended with the discrete components include, but are not limited to, water blocking materials, super absorbent polymers, flame retardant materials, smoke suppressants, extinguishants, mica flakes, solid and/or hollow glass spheres, solid and/or hollow polymeric microspheres, etc. The additives may have any suitable dimensions, such as any suitable diameters, lengths, etc. In certain embodiments, one or more additives may have dimensions that are similar to those of the discrete components 115. Additionally, a wide variety of suitable ratios between discrete components 115 and additives may be utilized as desired. For example, the additives may comprise approximately 5, 10, 15, 20, 25, 30, 35, 40, 45, or 50 percent by weight or by volume of the overall mixture, a percentage included in a range between any two of the above values, or a percentage bounded on either a minimum or maximum end by one of the above values.

Any number of discrete components 115 may be incorporated into a cable 100. Due to gaps and/or spacings between adjacent discrete components 115, the discrete components may not take up or occupy all of the space between twisted pairs and/or in other interstices within a cable core. Thus, in certain embodiments, a combination of the discrete components 115 and a gas (e.g., air) may fill one or more interstices. As desired, the discrete components 115 may be incorporated into a cable 100 in accordance with a wide variety of suitable filling ratios and/or densities. For example, in certain embodiments, the discrete components 115 positioned within a given cross-sectional space between any two twisted pairs, between the plurality of twisted pairs 105A-D, and/or within one or more interstices of a cable core may have a bulk density that facilitates the discrete components 115 (and/or a combination of the discrete components 115 and gas between adjacent discrete components) having a dielectric constant between approximately 1.7 and approximately 3.4 For example, a dielectric constant of approximately 1.7, 2.0, 2.2, 2.4, 2.5, 2.6, 2.8, 3.0, 3.2, 3.4, a dielectric constant incorporated into a range between any two of the above values, or a dielectric constant incorporated into a range bounded on either a minimum or maximum end by one of the above values may be provided.

Figure 3A:
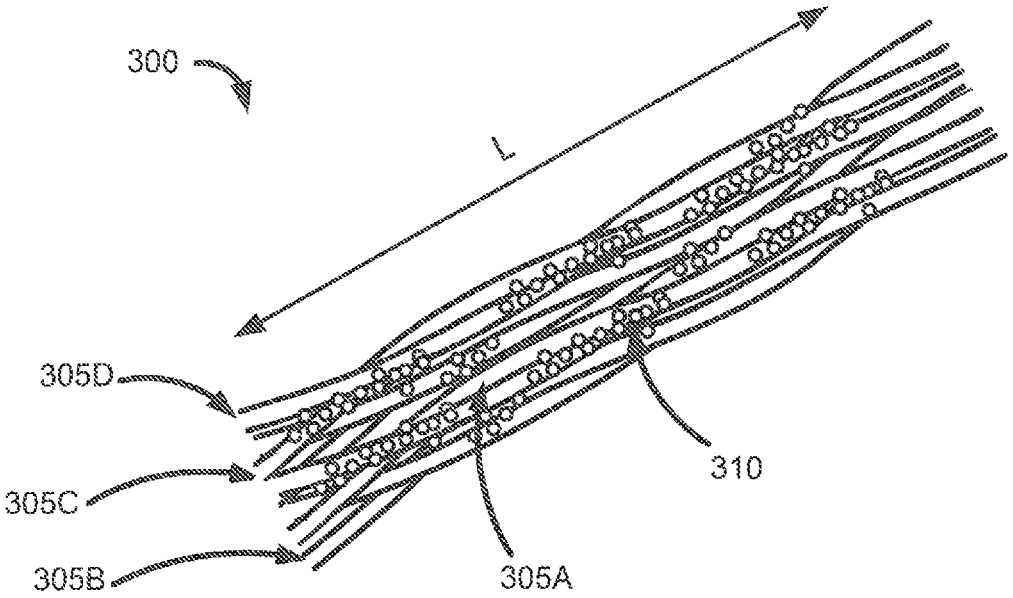
FIGS. 3A-3B are perspective views of example twisted pair cable cores that include discrete components of insulation material positioned at one or more longitudinal locations, according to an illustrative embodiment of the disclosure.
Figure 3B:
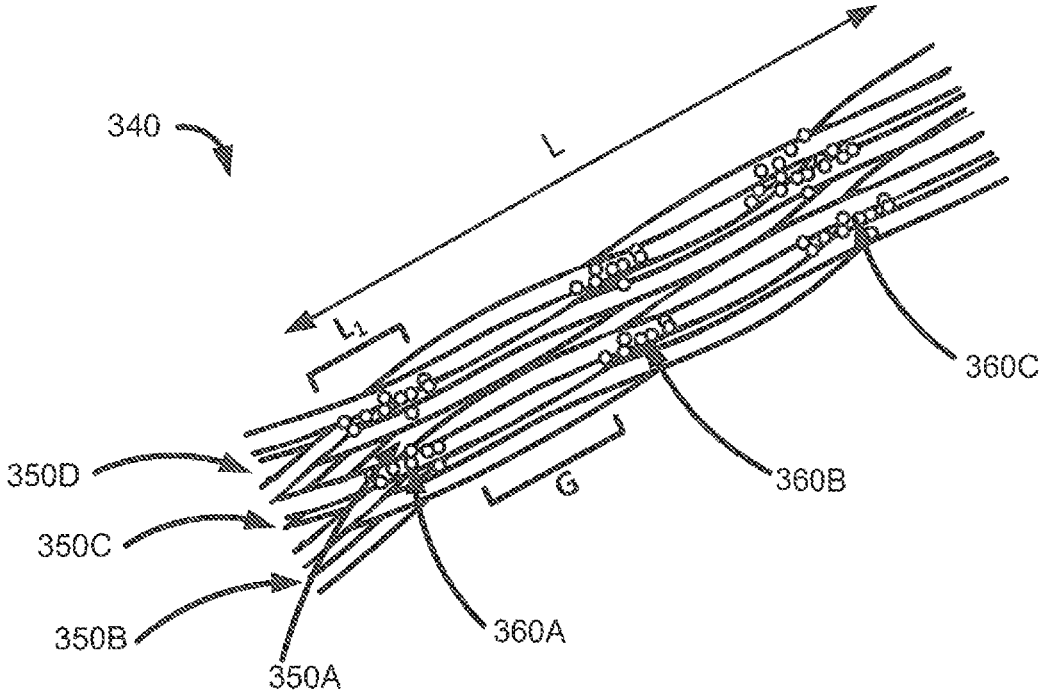

In certain embodiments, discrete components 115 may be incorporated relatively continuously along a longitudinal length of a cable 100. In other words, discrete components 115 may be positioned at any given cross-sectional location along the longitudinal length of the cable 100. In other embodiments, discrete components 115 may be incorporated into a cable 100 at any number of spaced locations along its longitudinal length. FIGS. 3A and 3B respectively illustrate example cable cores in which discrete components 115 are positioned in a continuous and in a spaced manner. In the event that discrete components 115 are incorporated into a cable 100 at spaced locations, a section or area of discrete components 115 may have any suitable longitudinal length. Examples of suitable longitudinal lengths include, but are not limited to, 0.1 m, 0.25 m, 0.3 m, 0.4 m, 0.5 m, 0.75 m, 1.0 m, 1.25 m, 1.5 m, 2.0 m, 2.5 m, 3.0 m, 4.0 m, 5.0 m, 10.0 m, a value incorporated in a range between any two of the above values, or a value incorporated in a range bounded on a minimum or maximum end by one of the above values (e.g., a value greater than 5.0 m, etc.). Additionally, a wide variety of suitable gaps or separation distances may be present between adjacent sections of discrete components 115. Examples of suitable separation gaps include, but are not limited to, 0.05 m, 0.07 m, 0.1 m, 0.15 m, 0.2 m, 0.25 m, 0.3 m, 0.4 m, 0.5 m, 0.75 m, 1.0 m, a value incorporated in a range between any two of the above values, or a value incorporated in a range bounded on a minimum or maximum end by one of the above values. In certain embodiments, spaced sections of discrete components 115 may be incorporated into a cable 100 in accordance with a pattern having a repeating step. In other embodiments, spaced sections of discrete components 115 may be incorporated in a random or pseudorandom manner.

Additionally, a wide variety of suitable systems and/or methods may be utilized as desired to incorporate discrete components 115 into a cable 100. For example, as a plurality of twisted pairs 105A-D are brought together and/or bunched (e.g., helically twisted together), discrete components 115 may be positioned between the twisted pairs 105A-D. In certain embodiments, the twisted pairs 105A-D may be passed through a dust chamber or other suitable device that is filled with discrete components 115, and the discrete components 115 may be trapped between the twisted pairs 105A-D and/or may collect on outer surfaces of the twisted pairs 105A-D. In other embodiments, discrete components 115 may be positioned via air blowing the discrete components 115 into interstices, via electrostatic charge, and/or via a wide variety of other suitable techniques. A jacket 110 or other outer wrap may then be extruded or otherwise formed around the twisted pairs 105A-D and the discrete components 115. In certain embodiments, discrete components 115 may be positioned between the twisted pairs 105A-D and the outer wrap. In other embodiments, an outer periphery of the twisted pairs 105A-D may be wiped or otherwise cleaned to remove discrete components 115 prior to the formation of the jacket 110 or other outer wrap.

As a result of incorporating discrete components 115 between a plurality of twisted pairs 105A-D and/or between twisted pairs 105A-D and an outer wrap (e.g., a jacket 110, a shield 120), separation distances may be provided between various twisted pairs 105A-D and/or between the twisted pairs 105A-D and an outer wrap. These separation distances may assist in reducing crosstalk and/or improving the electrical performance of a cable 100. Additionally, in certain embodiments, separation may be achieved via the use of less material than that required in conventional cables utilizing relatively continuous separators. Indeed, in certain applications, separation may be achieved using recycled material. Thus, material and cable cost may be reduced. The use of recycled materials may promote sustainability in the manufacture of the cable and/or lessen environmental impact. Further, the use of relatively small discrete components may contribute to increased cable flexibility and/or easier termination. A continuous separator may be relatively stiff, thereby limiting the flexibility of a cable as it is bent. However, the use of discrete components 115 may facilitate easier bending and/or promote cable flexibility.

As desired in various embodiments, a wide variety of other materials may be incorporated into the cable 100. For example, as set forth above, the cable 100 may include any number of conductors, twisted pairs, optical fibers, and/or other transmission media. As another example, one or more respective dielectric films or other suitable components may be positioned between the individual conductors of one or more of the twisted pairs 105A-D. In certain embodiments, one or more tubes or other structures may be situated around various transmission media and/or groups of transmission media. Additionally, as desired, a cable may include a wide variety of strength members, swellable materials (e.g., aramid yarns, blown swellable fibers, etc.), flame retardants, flame suppressants or extinguishants, gels, and/or other materials. The cable 100 illustrated in FIG. 1 is provided by way of example only. Embodiments of the disclosure contemplate a wide variety of other cables and cable constructions. These other cables may include more or less components than the cable 100 illustrated in FIG. 1. Additionally, certain components may have different dimensions and/or materials than the components illustrated in FIG. 1. Further, a wide variety of different cable components may be formed to include one or more cavities in which extinguishant may be positioned.

Figure 2:
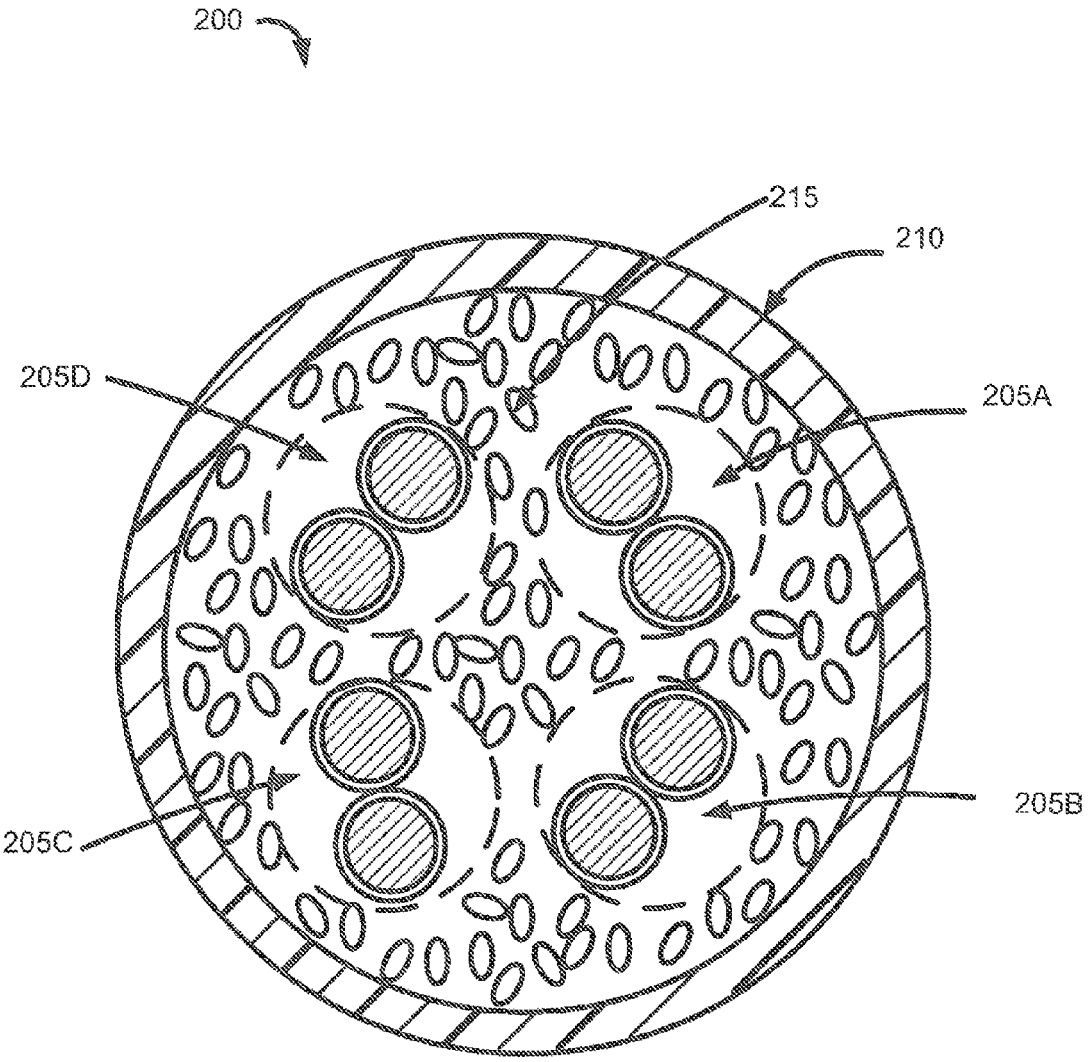
FIG. 2 is a cross-sectional view of an example twisted pair cable that includes discrete components of insulation material positioned between the twisted pairs and between the twisted pairs and an outer jacket, according to an illustrative embodiment of the disclosure.

FIG. 2 is a cross-sectional view of another example twisted pair cable 200 that includes discrete components of insulation material positioned between a plurality of twisted pairs. The cable 200 of FIG. 2 may include components that are similar to the cable 100 illustrated and described above with reference to FIG. 1. Accordingly, the cable 200 may include a plurality of twisted pairs 205A-D disposed in a cable core. A jacket 210 may be formed around the twisted pairs 205A-D and, as desired, one or more shield layers (not shown) or other suitable wraps may be formed around one or more twisted pairs 205A-D. Additionally, discrete components 215 of insulation material may be incorporated into the cable 200.

As shown in FIG. 2, the discrete components 215 may be positioned both between the twisted pairs 205A-D and between an outer periphery of the twisted pairs 205A-D and the jacket 210. By contrast, FIG. 1, illustrates a cable 100 in which discrete components 115 are only positioned in the interstices or spaces between the plurality of twisted pairs 105A-D. The outer periphery of the twisted pairs 205A-D may be the outer boundary of the cross-sectional area collectively occupied by the twisted pairs 205A-D, and the outer periphery of the twisted pairs 205A-D may extend along the longitudinal length of the cable 200.

In certain embodiments, discrete components 215 may be positioned both between the twisted pairs 205A-D and along an outer periphery of the twisted pairs 205A-D either continuously along the cable's longitudinal length or in a plurality of spaced sections. As desired above, sections of discrete components 215 and/or gaps between sections may be formed with a wide variety of suitable inventions. In other embodiments, discrete components 215 may be positioned in one area of the cable 200 (e.g., between the twisted pairs 205A-D, etc.) in a longitudinally continuous manner and positioned in another area of the cable 200 (e.g., along an outer periphery, etc.) in a spaced relationship. In yet other embodiments, discrete components 215 may be positioned between the twisted pairs 205A-D and an outer wrap (e.g., the jacket 210) without discrete components 215 also being positioned between the plurality of twisted pairs 205A-D. Indeed, a wide variety of suitable arrangements and/or configurations of discrete components 215 may be utilized as desired.

Similar to the cable 100 illustrated in FIG. 1, the cable 200 illustrated in FIG. 2 is provided by way of example only. Embodiments of the disclosure contemplate a wide variety of other twisted pair cables and/or other cable constructions. These other cables may include more or less components than the cables 100, 200 illustrated in FIGS. 1 and 2. For example, other cables may include alternative shielding arrangements and/or different arrangements of discrete components. Additionally, certain components may have different dimensions and/or materials than the components illustrated in FIGS. 1 and 2.

As set forth in greater detail above, discrete components may be incorporated into a cable, such as one of the cables 100, 200 illustrated in FIGS. 1 and 2, at a wide variety of positions along the cable's longitudinal length. FIGS. 3A and 3B illustrate perspective views of example twisted pair cable cores 300, 340 that include discrete components of insulation material positioned at one or more longitudinal locations, according to an illustrative embodiments of the disclosure. These example cores 300, 340 may be incorporated into a wide variety of suitable cables as desired.

Turning first to FIG. 3A, a perspective view of a first example cable core 300 is illustrated. The cable core 300 may include a plurality of twisted pairs 305A-D that extend in a longitudinal direction "L". As desired, the twisted pairs 305A-D may be helically twisted or wrapped together along the longitudinal direction. Additionally, as shown, discrete components 310 of insulation material may be positioned in the interstices between the twisted pairs 305A-D in a relatively continuous manner along the longitudinal direction. Similarly, although not illustrated because it would obscure the other components of the cable core 300, discrete components 310 may be positioned along an outer periphery of the twisted pairs 305A-D.

Turning now to FIG. 3B, a perspective view of another example cable core 340 is illustrated. The cable core 340 may include a plurality of twisted pairs 350A-D that extend in a longitudinal direction "L". As desired, the twisted pairs 350A-D may be helically twisted or wrapped together along the longitudinal direction. Additionally, discrete components of insulation material may be positioned in the interstices between the twisted pairs 305A-D at a plurality of spaced locations 360A-C along the longitudinal direction. Similarly, although not illustrated, discrete components may be positioned along an outer periphery of the twisted pairs 350A-D.

As set forth above, sections 360A-C of discrete components may be formed with a wide variety of suitable dimensions. For example, a section of discrete components (generally referred to as section 360) may have any suitable longitudinal length "$L_1$". Additionally, any suitable gap or spacing "G" in the longitudinal direction may be present between adjacent sections. A few non-limiting example lengths and/or gap sizes are described in greater detail above with reference to FIG. 1. In certain embodiments, sections may be arranged in accordance with a desired pattern. In other embodiments, sections may be arranged in a random or pseudorandom manner.

The cable cores 300, 340 illustrated in FIGS. 3A and 3B are provided by way of non-limiting example only. Embodiments of the disclosure contemplate a wide variety of other suitable cable cores. These other cable cores may include more or less components than the cable cores 300, 340 illustrated in FIGS. 3A and 3B. Additionally, cable cores may have any suitable arrangement of discrete components.

Figure 4:
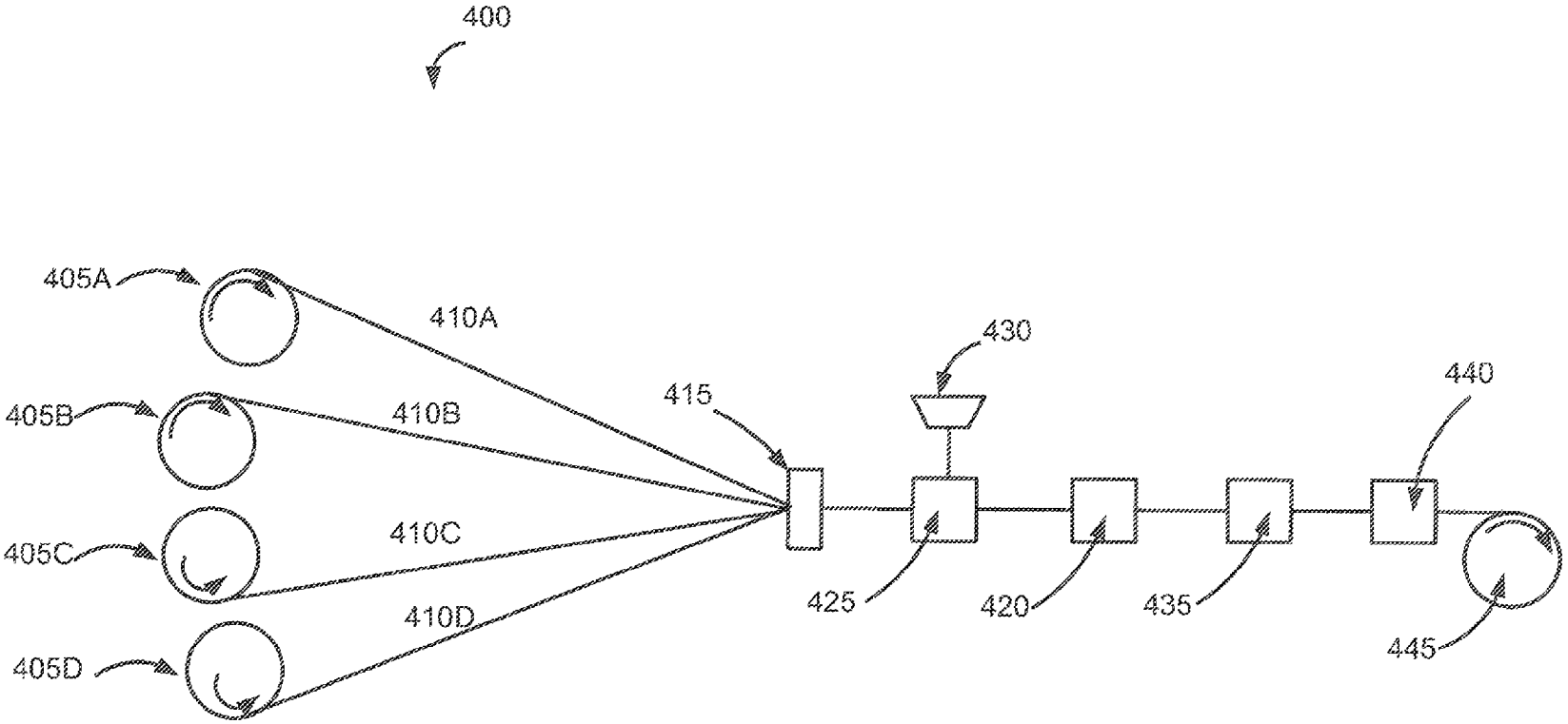
FIG. 4 is a block diagram of an example system for positioning discrete components of insulation material in a twisted pair cable, according to an illustrative embodiment of the disclosure.

A wide variety of suitable systems and/or components may be utilized to incorporate discrete components into a cable, such as one of the cables 100, 200 illustrated in FIGS. 1 and 2, as desired in various embodiments. FIG. 4 depicts a block diagram of an example system 400 that may be utilized to incorporate discrete components into a cable. With reference to the system 400, a plurality of sources 405A-D of twisted pairs 410A-D may be provided. In certain embodiments, the sources 405A-D may include payoffs, reels, bins, or other suitable components that may function to payout or otherwise provide twisted pairs 410A-D downstream to other components of the system 400. In other embodiments, one or more of the twisted pairs 410A-D may be provided in an in-line manner from one or more devices that manufacture and/or twist conductors together in order to form the twisted pairs 410A-D.

The twisted pairs 410A-D may be fed to a suitable accumulation point 415, and the twisted pairs 410A-D may be stranded or twisted together via any number of suitable twisting devices 420. In other words, an overall lay or twist may be imparted on the collective plurality of the twisted pairs 410A-D. A wide variety of suitable devices may be utilized to accumulate and twist the twisted pairs 410A-D including, but not limited to, bunching devices (e.g., bunching dies, etc.), stranding devices (e.g., stranding dies etc.), and/or cabling devices.

Additionally, either before the twisted pairs 410A-D are stranded together and/or during the stranding of the twisted pairs 410A-D, a wide variety of suitable application systems and/or devices 425 may be utilized to position discrete components between the twisted pairs 410A-D and/or around the twisted pairs 410A-D. A suitable supply 430 of discrete components, such as a bin or a hopper, may provide discrete components to the application device(s) 425. In certain embodiments, the application device(s) 425 may include one or more dust chambers or other suitable devices that the twisted pairs 410A-D may be passed through. As the twisted pairs 410A-D are passed through the application device(s) 425, discrete components may collect between and/or around the twisted pairs 410A-D. In other embodiments, the application device(s) 425 may include one or more suitable devices that are configured to air blow or otherwise force discrete components into the interstices between the twisted pairs 410A-D and/or around the twisted pairs 410A-D. In yet other embodiments, the application device(s) 425 may include one or more devices that are configured to impart an electrostatic charge onto the discrete components and/or the twisted pairs 410A-D to facilitate positioning of the discrete components via electrostatic charge. In yet other embodiments, the application device(s) 425 may include one or more suitable extrusion devices (e.g., extrusion heads, etc.) configured to extrude discrete components between and/or around the twisted pairs 410A-D. A wide variety of other suitable application devices 425 may be utilized as desired.

As desired, the twisting devices 420 and the application device(s) 425 may be synchronized via any number of suitable computing and/or control devices. In certain embodiments, the synchronization may facilitate the positioning of the discrete components. For example, as discrete components are positioned between the twisted pairs 410A-D via one or more application devices 425, the twisting devices 420 may impart a suitable twist on the pairs in order to trap or hold the discrete components in place.

As desired in various embodiments, discrete components may be positioned between and/or around the twisted pairs 410A-D. In certain embodiments, one or more suitable devices and/or components 435, such as a wiping device (e.g., a cloth, etc.), may be utilized to wipe or clean an outer periphery of the twisted pairs 410A-D after they are twisted together. In this regard, an outer surface of the twisted pairs 410A-D may be substantially free of discrete components in the even that discrete components will not be positioned between the twisted pairs 410A-D and an outer wrap.

With continued reference to FIG. 4, one or more suitable devices may be utilized to form an outer wrap around the twisted pairs 410A-D and discrete components. For example, one or more suitable extrusion devices 440 may be utilized to extrude a jacket around the twisted pairs 410A-D and discrete components. As another example, one or more suitable dies and/or wrapping devices may be utilized to form a shield or other suitable layer around the twisted pairs 410A-D and discrete components. In the event that a shield or other wrap is formed, a jacket may subsequently be formed as desired in certain embodiments. Additionally, as desired, one or more suitable application devices similar to the application devices 425 described above may be utilized to apply or position discrete components around the twisted pairs 410A-D either prior to or during the formation of a jacket or suitable wrap layer.

Once a cable or cable core (e.g., a cable structure with no outer jacket, etc.) has been constructed, one or more suitable take-up devices 445 may be utilized to collect the cable. For example, the cable may be spooled onto one or more suitable reels or collected into suitable packaging (e.g., boxes, shrink wrap, etc.). In other embodiments, the cable may be provided to any number of suitable downstream devices, such as one or more systems or components that incorporate the cable or cable core into a larger structure, such as a composite cable.

The system 400 discussed above with reference to FIG. 4 is provided by way of example only. A wide variety of other suitable systems may include more or less than the components illustrated in FIG. 4. Additionally, any suitable arrangements and/or ordering of components may be utilized in order to facilitate desired application goals and/or cable constructions.

Figure 5:
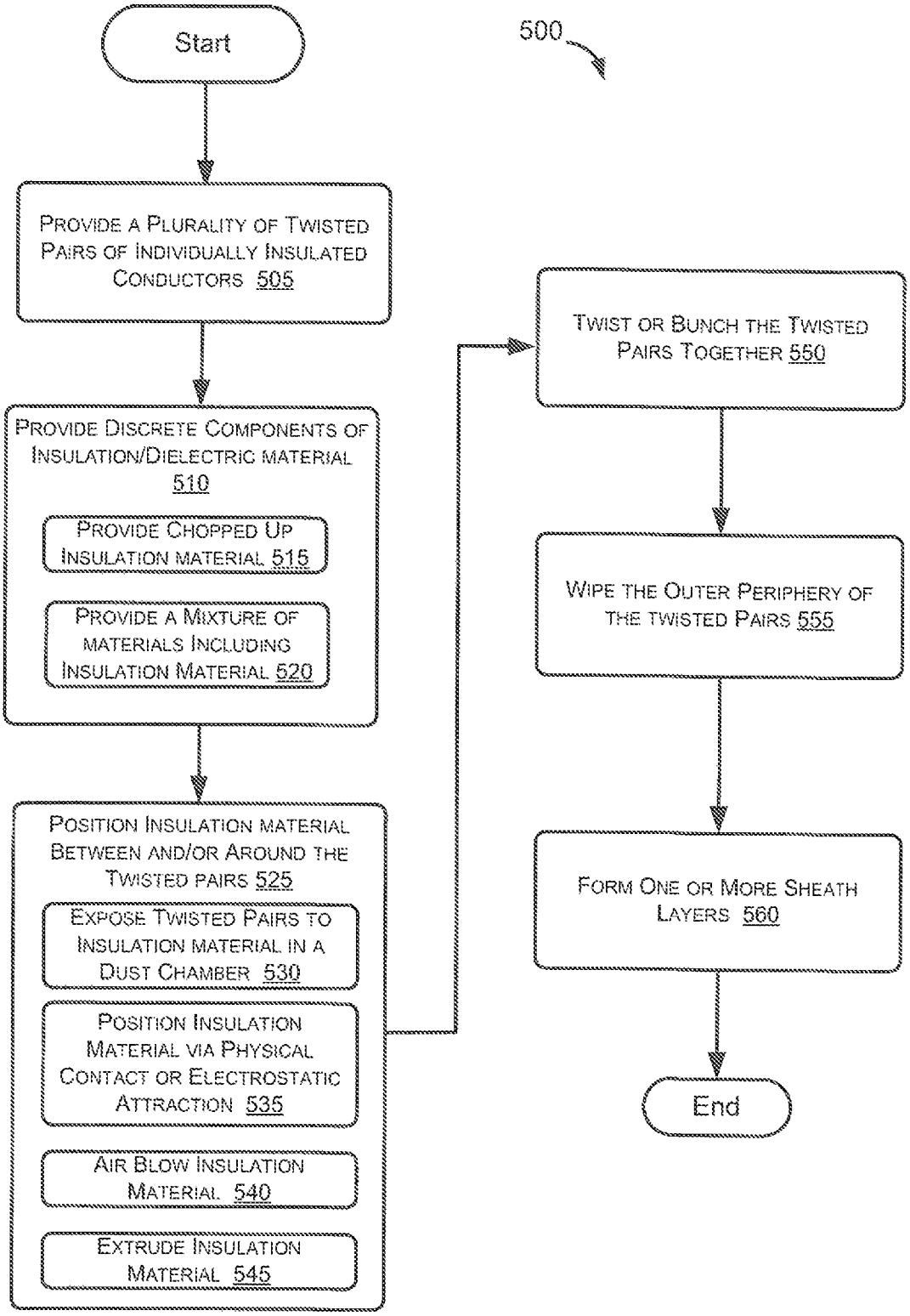
FIG. 5 is a flow chart of an example method for positioning discrete components of insulation material in a twisted pair cable, according to an illustrative embodiment of the disclosure.

FIG. 5 illustrates a flowchart of an example method 500 for incorporating discrete components into a cable, such as one of the cables 100, 200 illustrated in FIGS. 1 and 2. The method 500 may be carried out utilizing a wide variety of suitable systems and/or components, such as the system 400 illustrated in FIG. 4. The method 500 may begin at block 505. At block 505, a plurality of twisted pairs of individually insulated conductors, such as the conductors 105A-D illustrated in FIG. 1, may be provided. For example, one or more twisted pairs may be constructed via drawing electrically conductive material (e.g., copper, etc.), applying insulation around the electrically conductive material, and twisting two insulated conductors together. As another example, preformed twisted pairs may be provided via any number of suitable spools, reels, or other supplies.

At block 510, discrete components of insulation and/or dielectric material may be provided. A wide variety of suitable discrete components and/or mixtures containing discrete components may be provided as desired. For example, at block 515, chopped up, shredded, or otherwise processed insulation material may be provided as discrete components. In certain embodiments, the discrete components may include insulation material that has been reclaimed via recycling other cable components, such as conductor insulation, separators, outer jackets, etc. As another example, at block 520, a mixture of materials that include insulation material may be provided. Insulation material or discrete components may be blended or mixed with a wide variety of suitable additives as desired in various embodiments, such as flame retardant material, water blocking material, etc.

At block 525, the discrete components may be positioned between and/or around the twisted pairs. As set forth in greater detail above, a wide variety of suitable methods and/or techniques may be utilized to position the discrete components. For example, at block 530, the twisted pairs may be exposed to the discrete components and/or passed through discrete component material in one or more dust chambers. As another example, at block 535, discrete components may be positioned via physical contact with the twisted pairs and/or via electrostatic attraction. As another example, at block 540, discrete components may be air blown into one or more suitable interstices. As yet another example, at block 545, discrete components may be extruded between and/or around the twisted pairs.

At block 550, the twisted pairs may be twisted and/or bunched together, thereby trapping or holding certain discrete components in place. As desired, an outer periphery of the twisted pairs may optionally be wiped or cleaned at block 555 in order to remove any discrete components positioned around an outer periphery of the twisted pairs. One or more suitable sheath layers, such as a shield layer and/or an outer jacket, may then be formed around the twisted pairs and discrete components at block 560. One or more finishing operations, such as take-up of the cable or provision of the cable to one or more downstream devices, may then occur. The method 500 may end following block 560.

As desired in various embodiments, the method 500 may include more or less operations than those described above with reference to FIG. 5. For example, discrete components may be positioned around the twisted pairs and/or between the twisted pairs an outer sheath layer following the bunching or twisting of the twisted pairs. Additionally, in certain embodiments, any number of the described operations may be carried out or performed in parallel. The described method 500 is provided by way of non-limiting example only.

Conditional language, such as, among others. "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cable comprising:

a plurality of twisted pairs of individually insulated conductors;

a plurality of loose discrete dielectric components that are not connected or bonded together positioned in the interstices between the plurality of twisted pairs, each of the discrete dielectric components having a largest dimension that is no greater than approximately 250 microns; and a jacket formed around the plurality of twisted pairs and the plurality of discrete dielectric components.

2. The cable of claim 1, wherein the plurality of discrete dielectric components are further positioned between the plurality of twisted pairs and the jacket.

3. The cable of claim 1, wherein the plurality of discrete dielectric components have a bulk density with a dielectric constant between approximately 1.7 and approximately 3.4.

4. The cable of claim 1, wherein the plurality of discrete dielectric components comprise shredded insulation material.

5. The cable of claim 1, wherein the shredded insulation material is the same material as that used to insulate the plurality of twisted pairs.

6. The cable of claim 1, wherein none of the plurality of discrete dielectric components are connected to a common substrate layer.

7. The cable of claim 1, wherein the plurality of discrete dielectric components comprise sections of dielectric components longitudinally spaced from one another along a longitudinal length of the cable.

8. The cable of claim 1, further comprising at least one additive blended with the plurality of discrete dielectric components, the at least one additive comprising one or more of (i) a water blocking material, (ii) a super absorbent polymer, or (iii) a flame retardant material.

9. A cable comprising:

a plurality of twisted pairs of conductors that are individually insulated with an insulation material;

a plurality of loose discrete components of the insulation material that are not connected or bonded together positioned between the plurality of twisted pairs, each of the discrete components each having a largest dimension that is no greater than approximately 250 microns; and a jacket formed around the plurality of twisted pairs and the plurality of dielectric components.

10. The cable of claim 9, wherein the plurality of discrete components are further positioned between the plurality of twisted pairs and the jacket.

11. The cable of claim 9, wherein the plurality of discrete components have a bulk density with a dielectric constant between approximately 1.7 and approximately 3.4.

12. The cable of claim 9, wherein none of the plurality of discrete components are connected to a common substrate layer.

13. The cable of claim 9, wherein the plurality of discrete components comprise sections of discrete components longitudinally spaced from one another along a longitudinal length of the cable.

14. The cable of claim 9, further comprising at least one additive blended with the plurality of discrete components, the at least one additive comprising one or more of (i) a water blocking material, (ii) a super absorbent polymer, or (iii) a flame retardant material.

15. A cable comprising:

a plurality of twisted pairs of individually insulated conductors;

a plurality of discrete dielectric components positioned in the interstices between the plurality of twisted pairs and having a bulk density with a dielectric constant between approximately 1.7 and approximately 3.4, each of the discrete components having a largest dimension that is no greater than approximately 250 microns; and a jacket formed around the plurality of twisted pairs and the plurality of discrete dielectric components.

16. The cable of claim 15, wherein the plurality of discrete components comprise loose components that are not connected or bonded together.

17. The cable of claim 15, wherein the plurality of discrete components are further positioned between the plurality of twisted pairs and the jacket.

18. The cable of claim 15, wherein the plurality of discrete components comprise shredded insulation material.

19. The cable of claim 15, wherein the plurality of discrete components comprise sections of dielectric components longitudinally spaced from one another along a longitudinal length of the cable.

20. The cable of claim 15, further comprising at least one additive blended with the plurality of discrete dielectric components, the at least one additive comprising one or more of (i) a water blocking material, (ii) a super absorbent polymer, or (iii) a flame retardant material.

* * * * *